United States Patent [19]

Da Silva et al.

[11] Patent Number: 5,018,535

[45] Date of Patent: May 28, 1991

[54] METHOD AND APPARATUS FOR JOINING AND FEEDING STRIPS OF PAPER

[75] Inventors: Domingos Da Silva, Cortaillod; Roland Guinnard, Bevaix, both of Switzerland

[73] Assignee: Fabriques de Tabac Reunies, S.A., Neuchatel, Switzerland

[21] Appl. No.: 268,975

[22] Filed: Nov. 9, 1988

[30] Foreign Application Priority Data

Nov. 12, 1987 [CH] Switzerland ..... 04413/87

[51] Int. Cl.[5] ..... A24C 5/47

[52] U.S. Cl. ..... 131/60; 131/95; 131/105; 131/67; 270/52; 270/58; 156/159

[58] Field of Search ..... 131/280, 84.1, 94, 95, 131/105; 156/159; 270/52, 58

[56] References Cited

U.S. PATENT DOCUMENTS 2,724,426 11/1955 Bell et al. .

FOREIGN PATENT DOCUMENTS 1287020 1/1962 France .
1086065 10/1967 United Kingdom .
2174371 11/1986 United Kingdom .
2178413 2/1987 United Kingdom .

*Primary Examiner*—V. Millin
*Attorney, Agent, or Firm*—Jeffrey H. Ingerman

[57] ABSTRACT

The trailing end (5) of a strip of paper (8) which was wound on a first reel (3) is immobilized by means of suction devices (16, 17, 18) relative to a counterplate (19). The trailing end is severed by means of a cutter (29), the rear portion being discarded by blowing. The leading end of the new strip of paper (11) is then positioned between a punch (20) and the counterplate, immobilized by means of a suction device (18), and joined to the trailing end by interpenetration, brought about by the punch, of the material of two superposed joining areas.

18 Claims, 6 Drawing Sheets

METHOD AND APPARATUS FOR JOINING AND FEEDING STRIPS OF PAPER

Figure 1:
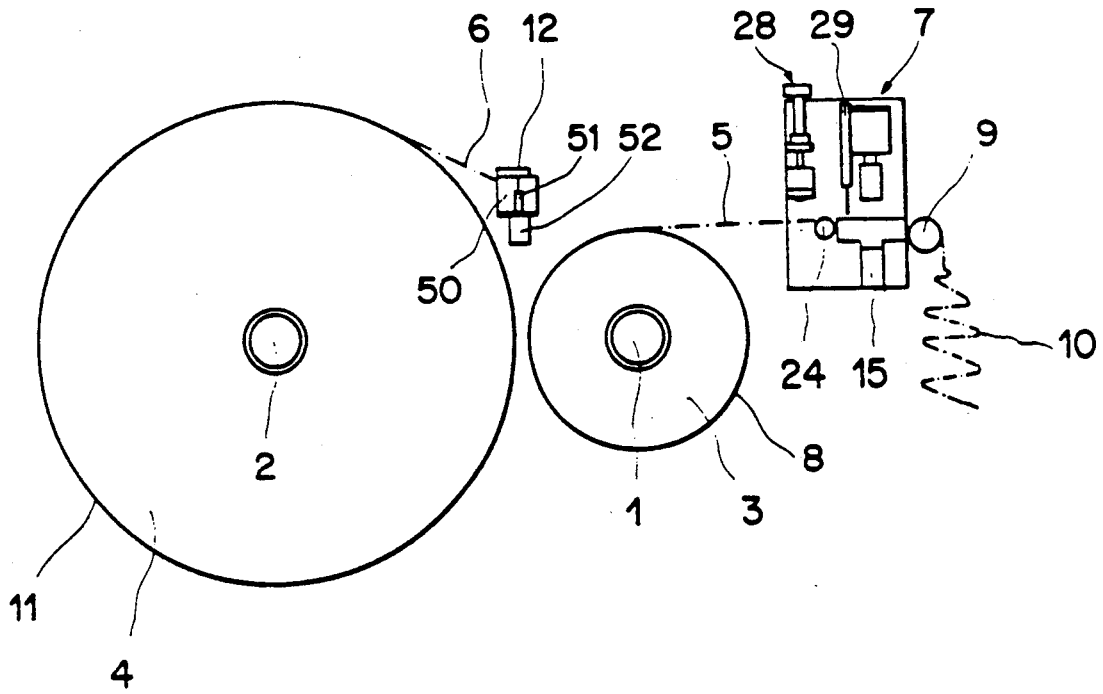

This invention relates to feeding systems, and more particularly to a method of assembling end to end strips of paper of finite length for continuously feeding a machine, especially a machine for manufacturing cigarettes, of the type wherein a final segment of a first strip and an initial segment of a second strip are brought into relative positions of mutual overlapping, and joining zones belonging to these segments are pressed against one another.

The invention further relates to a machine for carrying out the foregoing method, of the type having support means with parallel axes for two reels bearing the first and the second strip, respectively, a conveyor for moving an initial segment of the second strip from an initial position to a joining position in which that segment overlaps a final segment of the first strip, and a device for joining by interpenetration comprising a counterplate situated on one side of the segments in mutually overlapping position and a pressing component situated on the other side and capable of causing the interpenetration of superimposed joining zones belonging to the segments of the strips.

In continuously operating machines for manufacturing cigarettes or filters, the strips of paper which receive the tobacco and form the rod are supplied in the form of reels and therefore each have a definite length. Thus the end portion of each strip of paper must be joined to the leading portion of the following strip each time the reel is changed.

It is known to be preferable to effect this connection by interpenetration of material rather than by gluing. The two portions, first and last, of the strips to be joined must be placed in overlapping position and held there so that the controlled deformation necessary for ensuring interpenetration is carried out correctly.

In general these operations are carried out by means incorporated in the manufacturing machine, and these means comprise complicated, heavy, expensive devices, but without providing complete automation of the replacement of one finished reel by a full one.

According to U.K. patent application publication No. 2,174,371A, the two portions are held one above the other by superposed devices, then connection zones belonging to each of the portions are compressed, after which the portion are cut in back and in front of the connection zones, respectively.

According to French patent document No. 1,287,020, the leading portion of the new strip is held coinciding with the end portion of the old strip at the time of joining by a pair of cylinders between which the two strips are led, and the pressure parts themselves are two rollers rotating about their axes, between which the connection zones of the strip portions pass.

According to U.K. patent No. 1,086,065, the leading portion of the new strip is fixed to a roller above the end portion of the old strip, then a punch or die is lowered against a counter-surface so that connection zones belonging to the two portions, last and first, of the old and new strips, respectively are compressed and joined by interpenetration of material. The back and front parts of the trailing and leading portions are then severed. The arrangement of the cutting blades is such that there is still a risk of damaging parts of portions which ought not to be cut.

The prior art further includes U.S. Pat. No. 2,724,426, disclosing a method and apparatus capable of carrying out connections between webs of wrapping material unwinding from successive rolls. The connection is made by welding. In this case, the trailing end of the old web and the leading end of the new web are respectively severed at the back and front of the connection zone before these zones are superimposed, and this latter step is carried out afterward, which requires complicated equipment.

It is an object of this invention to provide an improved method and apparatus for joining strips of paper wherein the sequence of operations to be effected differs from that of the various prior art solutions.

Another object of the invention is to provide simple, compact apparatus for joining strips of paper which operates accurately and reliably.

To this end, in the method according to the present invention, of the type initially mentioned, the final segment of the first strip is immobilized relative to a counterplate surface, then cut along a line situated to the rear of its connection zone, after which the cut portion of the segment is eliminated, the initial segment of the second strip is brought facing the final segment of the first strip, an immobilization zone of the initial segment of the second strip, situated to the rear of the cutting line of the first strip, is immobilized relative to the counterplate surface, and a punch surface is moved against the counterplate surface.

In the apparatus according to the present invention for carrying out the foregoing method, also of the type initially mentioned, means for immobilization of the two strip segments are associated solely with the counterplate.

Figure 2:
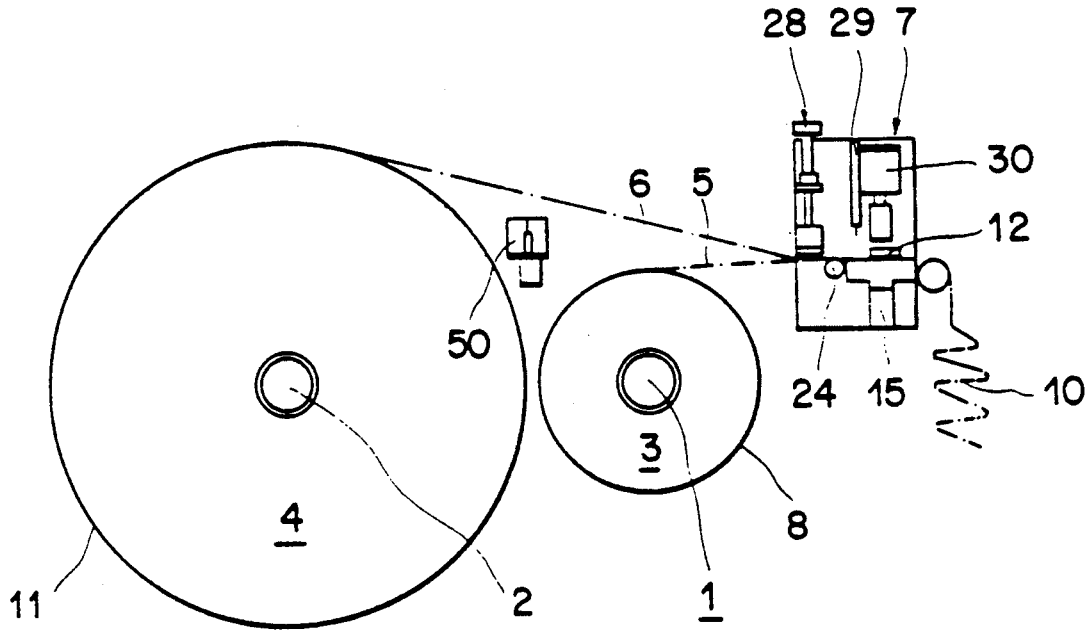
Figure 3:
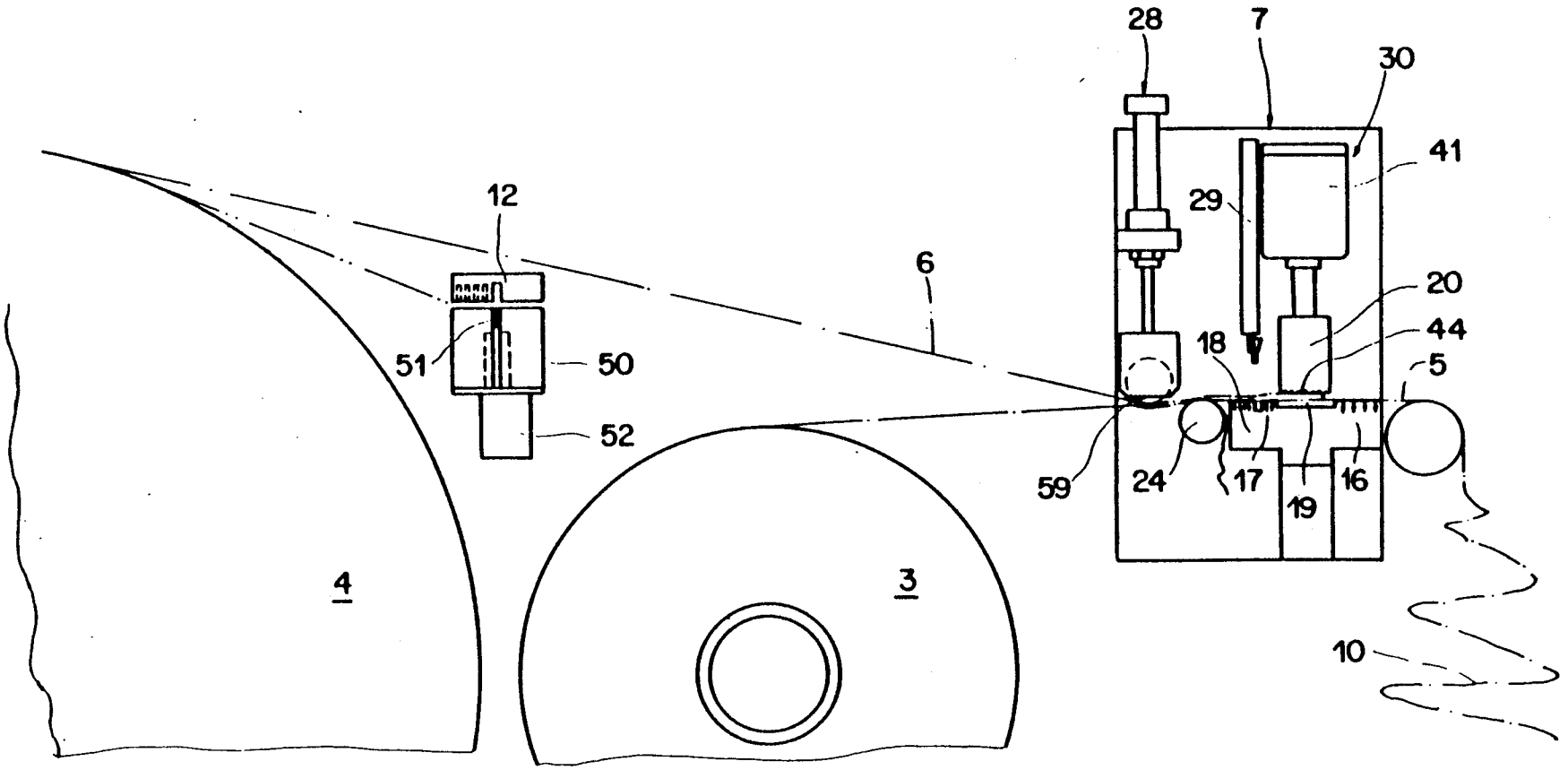
Figure 4:
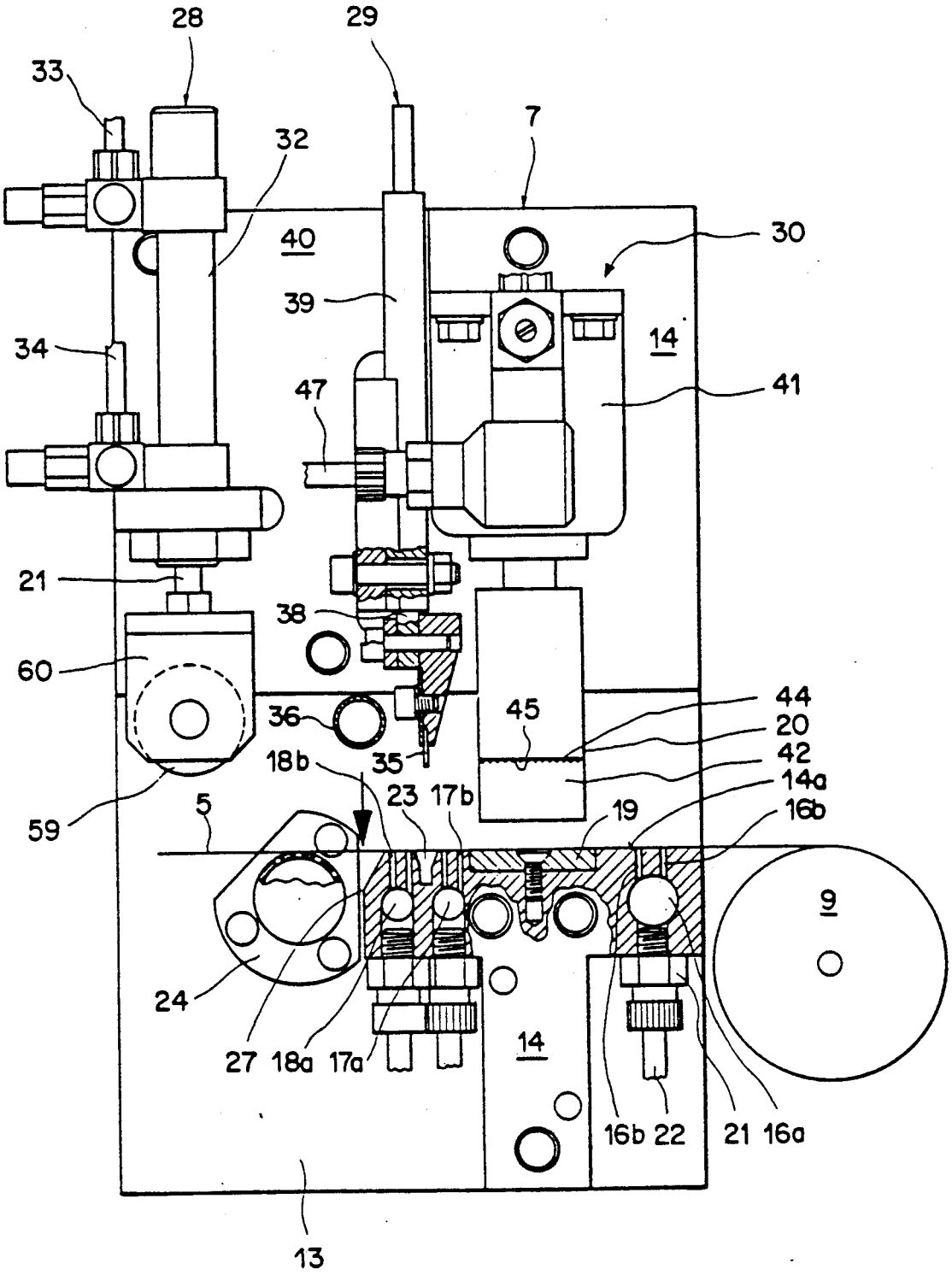
Figure 5:
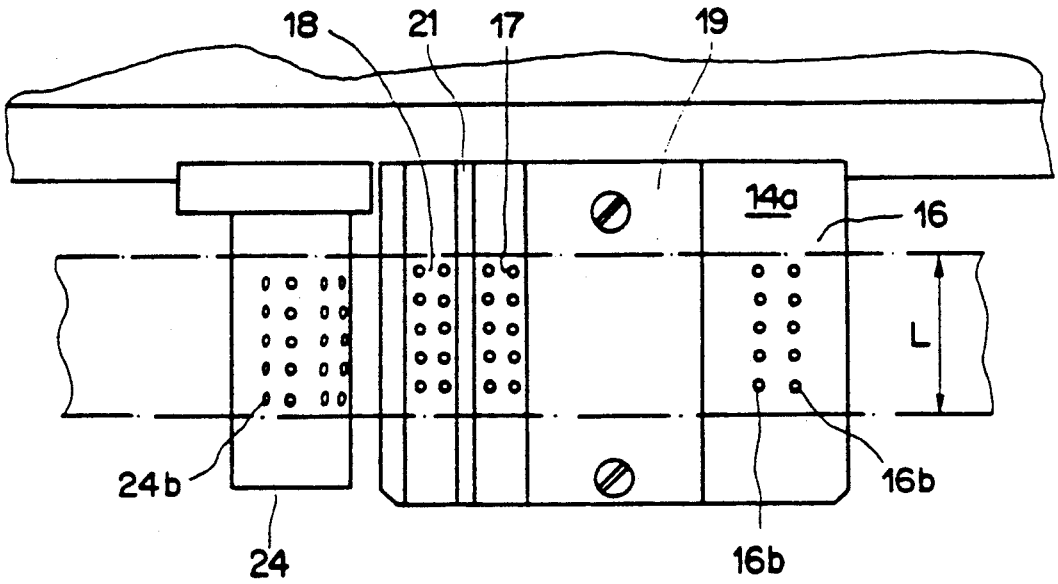
Figure 6:
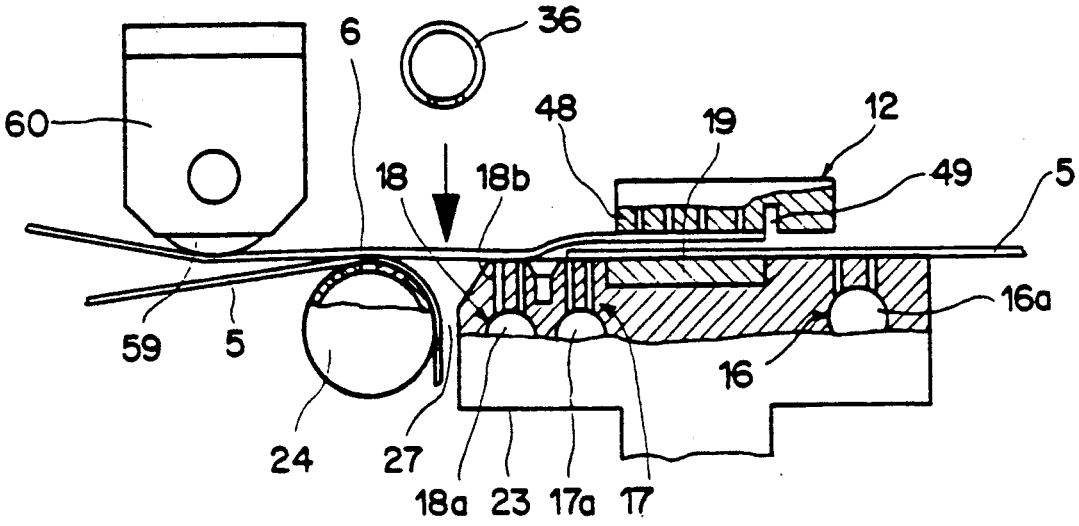
Figure 7:
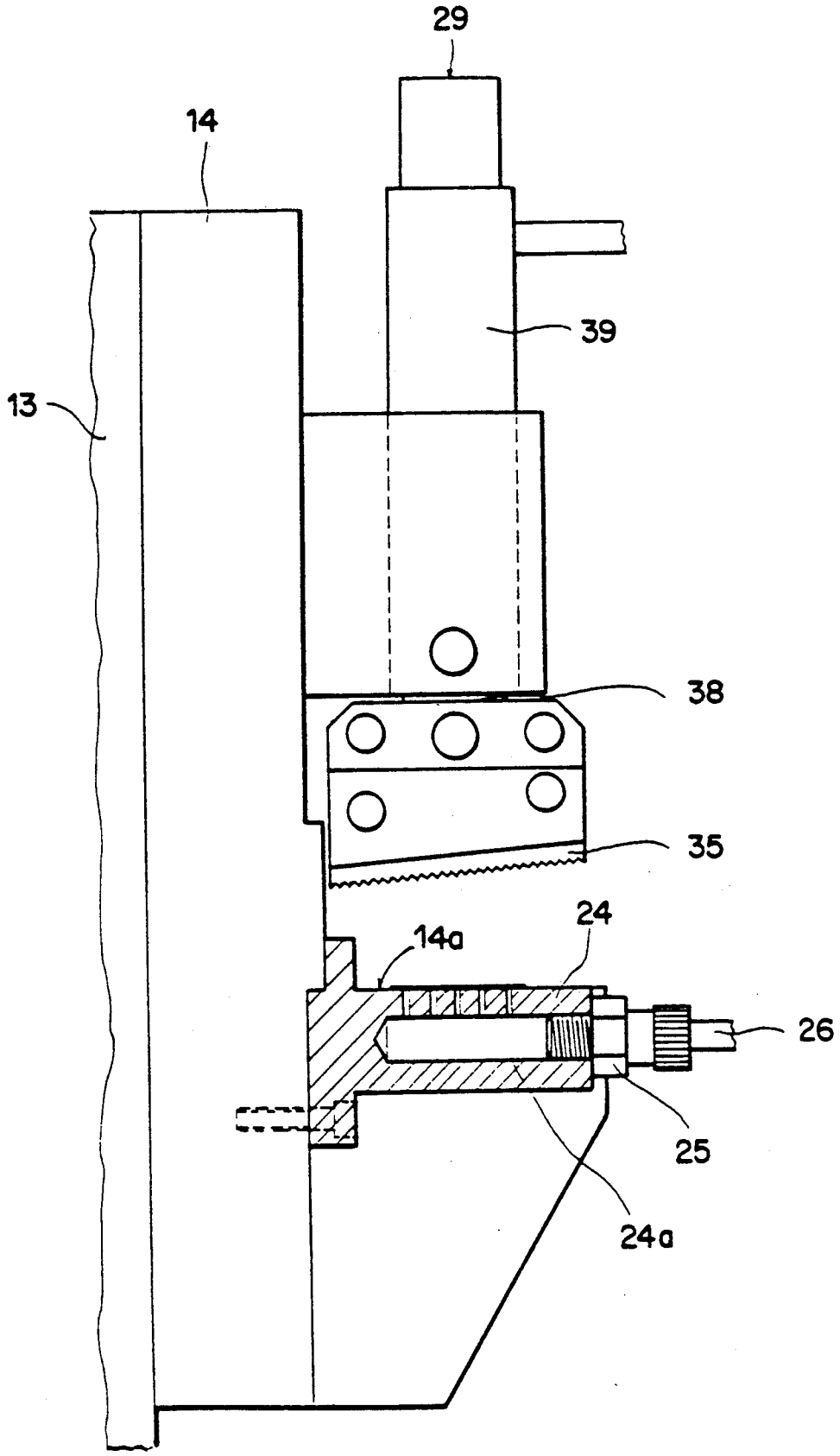
Figure 8:
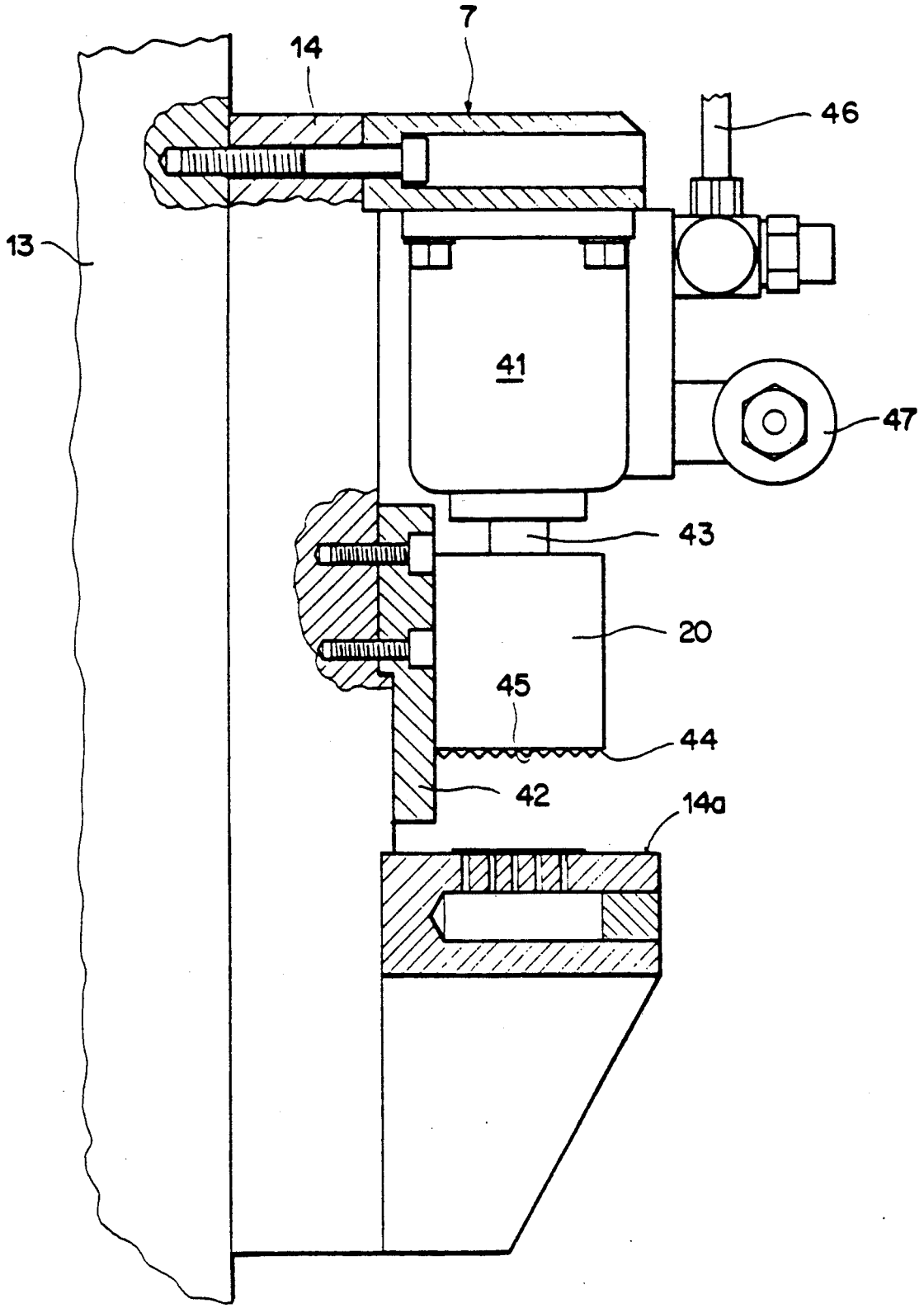

A preferred embodiment of the invention will now be described in detail with reference to the accompanying drawings, in which:

FIGS. 1, 2, and 3 are diagrammat1c elevations illustrating three successive steps in carrying out the method in assembly apparatus capable of working completely automatically, FIG. 4 is an elevation on a larger scale, partially in section, showing the essential elements of the joining mechanism, FIG. 5 is a partial top plan view showing the counterplate and the immobilizing means, FIG. 6 is a partial elevation, partially in section, showing the positioning of the joining zones in preparation for the punching operation, FIG. 7 is a side elevation of a cutter and a cylindrical suction device, and FIG. 8 is a side elevation of the interpenetration device.

FIGS. 1, 2, and 3 show the essential elements of the apparatus and illustrate how the method is carried out. A mandrel 1 supports a first reel 3 on which a strip of paper 8 is wound, and a mandrel 2 supports a second reel 4 on which a strip of paper 11 is wound. Mandrels 1 and 2 are disks situated at the same level, having parallel axes and being sufficiently spaced so that when the first reel 3 is coming to an end, the second reel 4 can be mounted on mandrel 2. Mandrels 1 and 2 supporting reels 3 and 4 are associated with a feed device which may be arranged in different ways according to whether the reels are put in place and prepared for unwinding by hand or mechanically. This feed device does not form part of the invention and will therefore not be described. The connection between an end portion 5 (FIG. 2) of strip 8 wound on reel 3 and a leading portion 6 of strip 11 borne by reel 4 takes place in a joining mechanism 7 to be described in detail below. In FIG. 1, strip 8 is seen to unwind from reel 3, pass over a roller 9, and then be led toward a cigarette-making machine. Before the final unwinding phase of reel 3, thus before the entire strip 8 has left mandrel 1 and is unwound, unwinding of reel 3 is activated (by means not shown) to create a reserve of paper 10 downstream from joining mechanism 7. It is then possible to block reel 3 in order to effect the connection. A last length of strip, forming the trailing portion 5, is then situated partly in mechanism 7, and a cutter 29 is actuated so as to cut portion 5 along a line situated at a predetermined location. Next, a conveyor 12 against which there has been immobilized the leading portion 6 of the strip of paper 11 wound on reel 4 is moved from a starting position shown in FIG. 1 to a joining position shown in FIG. 2, so that leading portion 6 of strip 11 faces end portion 5 of strip 8 and is superimposed thereon. Joining zones to be defined below and belonging to portions 5 and 6 are then exactly superimposed in joining mechanism 7. Portion 6 is immobilized relative to the counterplate of mechanism 7. Conveyor 12 is returned to its starting position, and the joining means are actuated to effect the connection between the trailing and leading ends of the strips by interpenetration, as shown diagrammatically in FIG. 3. During this operation, the reserve part 10 of strip 8 provides the necessary feed for the cigarette-making machine. Once the strips have been joined, the new reel 4 may be rotated, or to be exact, it is released, and a continuous strip of paper moves toward the manufacturing machine.

FIGS. 4 to 8 show various aspects of joining mechanism 7. A vertical-wall support 13 (FIGS. 7 and 8) bears a common bracket 14 which in turn supports the essential elements of the joining mechanism. Console 14 bears a counterplate 19 and is arranged to provide three fixed suction devices 16, 17, and lB. Counterplate 19 (see FIGS. 4, 5, and 6) situated at the center of and flush with the horizontal support surface 14*a* of bracket 14 is a plate designed to co-operate with a punch 20 situated above it, the operation of which will be described below. Suction device 16 is set in surface 14*a* in front of counterplate 19. It comprises a horizontal collector 16*a* communicating through two rows of five ducts 16*b* with surface 14*a* and a coupling 21 connected by a pipe 22 to a suction source. The orifices of ducts 16*b* open out in surface 14*a* in the form of two parallel rows distributed over a width corresponding to the width L of strips 8 and 11 borne by mandrels 1 and 2.

Suction devices 17 and 18 are made up similarly to device 16 and each comprise two rows of orifices 17*b* and 18*b* disposed side by side behind counterplate 19, there being a slot 23 between suction devices 17 and 18.

Finally, behind these devices, there is still another suction device 24 which comprises a cylindrical body fixed to bracket 14. This cylindrical body is provided with several rows of ducts 24*b* and comprises a central collector 24*a*. The latter is connected by a coupling 25 to a suction pipe 26. Suction device 24 is placed a certain distance behind the part of console 14 which bears suction devices 17 and 18. Between devices 24 and lB there is a slot 27, the function of which will be described below. It will be noted that the cylindrical body of suction device 24 is tangent to surface 14*a* and hence to the plane top surface of counterplate 19. Above these immobilizing and support means, joining mechanism 7 comprises a roller-type tensioning device 28, a cutter 29, and a punch 30. Tensioning device 28 consists essentially of a cylindrical roller 59 borne by a stirrup 60 fixed to the rod 21 of a jack 32. Pipes 33 and 34 of jack 32 are connected to a pneumatic or hydraulic control device. At the proper moment, roller 59 is lowered toward the immobilizing means, as will be described below. Cutter 29 is also shown in FIG. 7. It comprises a blade 35 fixed to the bottom of the rod 38 of a jack 39. Cutter 29 may be so controlled as to move up or down. As may be seen in FIG. 4, when it moves down, blade 35 enters slot 23 and cuts strip 8 along a line perpendicular to the direction of travel of the paper. At the time of this operation, the part of this strip situated above suction devices 17 and 18 is pulled down by suction and hence flattened against surface 14*a*. In addition, a stream of air from a blower 36 is directed at the strip of paper.

A side elevation of punch 30 may likewise be seen in FIG. 8. Fixed to bracket 14 are a jack 41 and a slide 42 capable of vertically guiding the body of punch 20, which is fixed to the rod 43 of jack 41. The body of punch 20 is shaped as a rectangular parallelepiped with a planar bottom face 44 provided with a relief formed of a network of points 45. Jack 41 is controlled via pipes 46 and 47.

Conveyor 12 and the means for immobilizing leading portion 6 of strip 11 against conveyor 12 will now be described. Conveyor component 12 (FIG. 6) is a plate equipped with suction ducts 48 and provided with a slot 49. Plate 12 is borne by a movable part (not shown) so as to be able to move from the position shown in FIG. 6, which is the joining position, to the starting position shown in FIGS. 1 and 3, then back to the joining position. In its starting position, plate 12 of the conveyor is in the vicinity of reel 4 (see FIGS. 1 and 3), exactly opposite a positioning element 50 equipped with a cutter 51 actuated by a jack 52.

When strip 8 wound on reel 3 is practically at an end and reserve 10 has been formed as stated at the beginning, unwinding of reel 3 is interrupted; and by actuating suction devices 16, 17, and 24, end portion 5 of strip 8 is immobilized against counterplate 19. At that moment leading portion 6 of strip 11 is detached from reel 4 and placed on positioning element 50.

Suction device 48 associated with conveyor 12 then binds the part of portion 6 situated on element 50 to the conveyor. Cutter 51 is actuated, and conveyor 12 is moved toward the joining position.

Conveyor arm 12 then describes a movement which brings it from the starting position shown in FIG. 1 to the joining position shown in FIG. 2. This joining position is determined precisely so that, as may be seen in FIG. 6, the cut edge of leading portion 6 is exactly flush with the front edge of counterplate 19, hence immediately beneath the front edge of surface 44 bearing points 45 of the body of punch 20 (see FIG. 3). When this position is reached, suction device 18 is again actuated, and tensioning device 28 is lowered so that roller 59 assumes the position shown in FIG. 6. On the other hand, suction device 48 is shut off, and conveyor 12 releases portion 6, then moves away from its joining position. Joining mechanism 7 is then in the position shown in FIG. 3. Jack 41 is actuated, and the body of punch 20 moves to press the two superposed portions 5 and 6 between its bottom surface 44 and the upper surface of counterplate 19. During this step, interpenetration of the paper of the two strip portions is brought about within respective zones constituting the joining zones of strip 8 with strip 11.

Once this connection is effected, punch 20 can be raised, and pulling of the strip of paper may continue.

Tests have shown that the means described above can establish a connection between successive strips of paper of the type used in the manufacture of cigarettes. This connection is sufficiently resistant to permit the formation of a continuous rod and the subsequent cutting of this rod into elements constituting cigarettes. The connection is carried out automatically and without using any glue.

The apparatus described, or in any case some of its elements, may be produced and may have different modes of operation while still accomplishing the same or similar functions according to whether partly or fully automatic operation is desired.

Conveyor 12 could be moved by a belt on a guide track or by pivoting about an arbor. As stated above, the displacement means must be so arranged that the conveyor's movements are particularly precise.

If need be, suction device 24 may be rotatable about its axis and controlled in such a way as to rotate through a certain angle at the moment when the cut part of portion 6 must release suction device 18.

Finally, the controls of the jacks and suction devices are connected to an electronic device capable of being programmed and monitored in such a way that each action takes place at the proper moment and that its correct execution is verified and confirmed. The necessary detectors are provided for that purpose at suitable locations.

Generally speaking, although suction devices are illustrated and described as immobilizing means and jacks as displacement means, it will be obvious that any other suitable means of immobilizing or displacement might be provided. However, the use of suction devices as immobilizing means simplifies the arrangement of the support surface of the bracket, for the group of suction devices may be placed under this support surface, thus beneath the strips of paper to be joined, which provides the necessary space for the movement of the conveyor which places portion 6 of strip 11 above portion 5 of strip 8.

What is claimed is:

1. A method of joining the ends of strips of paper of finite length for continuously feeding a machine, of the type wherein a trailing end of a first strip and a leading end of a second strip are brought into overlapping positions, and predetermined joining areas of the trailing and leading ends are pressed against one another, wherein the improvement comprises the successive steps of:

immobilizing and securing the trailing end relative to a counterplate, cutting the trailing end along a line situated upstream from the predetermined joining area thereof, discarding the cut-off portion of the trailing end, placing the leading end which is secured on a conveyor in a position overlappingly facing the trailing end, by displacing the conveyor to a position facing the counterplate, immobilizing and securing relative to the counterplate surface an immobilization portion of the leading end situated upstream from the line of severance of the second strip, releasing the leading end from the conveyor and returning the conveyor to its initial position, and pressing the overlapping leading and trailing ends between a punch surface and the counterplate to join the leading and trailing ends to one another.

2. The method of claim 1, wherein the predetermined joining areas pressed against on another undergo deformations capable of causing interpenetration of the material thereof.

3. The method of claim 2, wherein the cut-off portion of the trailing end is discarded by means of blowing.

4. The method of claim 1, the leading and trailing ends are immobilized relative to the counterplate of means of suction.

5. The method of claim 1, comprising the further steps of disposing a fixed nozzle opposite the counterplate and controlling the dispatch of a stream of air from the nozzle onto the cut-off portion of the trailing end for discarding it.

6. The method of claim 1, comprising the steps, for placing the leading end of the second strip in a position overlapping facing the trailing end, of immobilizing the leading end against a conveyor means, cutting the leading end at a predetermined location relative to the conveyor means, and moving the conveyor means in to a predetermined position relative to the counterplate surface, whereby the cut edge of the leading end is positioned opposite the front boundary of the predetermined joining area of the first strip.

7. Apparatus for joining the ends of strips of paper of finite length for continuously feeding a machine, of the type having two support means with parallel axes, two reels respectively mounted on said support means and respectively bearing a first and a second strip of paper, a conveyor for moving the leading end of the second strip from an initial position to a joining position wherein said leading end overlaps the trailing end of the first strip, and joining means for connecting said first and second strips by interpenetration of material, said joining means having a counterplate intended to be situated on one side of said overlapping leading and trailing ends and a pressing component facing said counterplate, wherein the improvement comprises:

immobilizing means associated solely with said counterplate for immobilizing said leading and trailing ends.

8. The apparatus of claim 7, wherein said immobilizing means comprise a first device for immobilizing said trailing edge and a second device for immobilizing said leading edge in such a way that said predetermined joining areas are superposed between said counterplate and said pressing component.

9. The apparatus of claim 7, wherein said pressing component is movable perpendicular to said counterplate and comprises a punch disposed parallel to said counterplate.

10. The apparatus of claim 9, wherein the surface of either said counterplate or said punch or both is provided with a network of projecting points.

11. The apparatus of claim 8, wherein said immobilizing means include three immobilizing elements disposed side by side upstream from said counterplate, said apparatus further comprising a cutter and a blower, said cutter being disposed so as to cut said trailing edge between the immobilizing element closest to said counterplate and the middle immobilizing element, a disposal space being provided between the immobilizing element the farthest from the counterplate and the middle immobilizing element and facing said blower so that said cut-off portion of said first strip is introduced into said space and releases said middle immobilizing element, the latter thus being released to immobilize said leading end upstream from the predetermined joining area thereof.

12. The apparatus of claim 11, wherein said immobilizing means are suction devices.

13. The apparatus of claim 12, wherein said farthest immobilizing element is a cylindrical suction device spaced from said counterplate but tangent to a prolongation thereof.

14. The apparatus of claim 13, wherein said immobilizing element farthest from said counterplate is rotatable about an axis perpendicular to the plane of travel of said strips of paper.

15. The apparatus of claim 7, further comprising a cutter cooperating with said conveyor in said initial position.

16. The apparatus of claim 7, wherein said conveyor is equipped with a suction device.

17. The method of claim 1 wherein said machine is a cigarette-making machine.

18. The apparatus of claim 7 wherein said machine is a cigarette-making machine.

* * * * *

UNITED STATES PATENT AND TRADEMARK OFFICE

CERTIFICATE OF CORRECTION

PATENT NO. : 5,018,535

DATED : May 28, 1991

INVENTOR(S) : Domingos da Silva et al.

It is certified that error appears in the above-identified patent and that said Letters Patent is hereby corrected as shown below:

Column 1, line 37, "position" should be -- positions --;

line 49, "portion" should be -- portions --.

Column 2, line 38, "diagrammatlc" should be -- diagrammatic --.

Column 3, line 39, "1B." should be -- 18. --;

line 63, "1B" should be -- 18 --.

Signed and Sealed this

Nineteenth Day of October, 1993

*Attest:*

Bruce Lehman

BRUCE LEHMAN

*Attesting Officer*

*Commissioner of Patents and Trademarks*